US009956773B2

(12) United States Patent
Watanabe et al.

(10) Patent No.: US 9,956,773 B2
(45) **Date of Patent: *May 1, 2018**

(54) LIQUID EJECTING HEAD AND LIQUID EJECTING APPARATUS

(71) Applicant: SEIKO EPSON CORPORATION, Tokyo (JP)

(72) Inventors: Shunsuke Watanabe, Matsumoto (JP); Katsumi Enomoto, Kanagawa-ken (JP); Ryota Kinoshita, Matsumoto (JP); Hiroyuki Ishii, Shiojiri (JP); Hiroshige Owaki, Okaya (JP); Takahiro Kanegae, Shiojiri (JP); Katsuhiro Okubo, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/202,050

(22) Filed: Jul. 5, 2016

(65) Prior Publication Data

US 2016/0311224 A1 Oct. 27, 2016

Related U.S. Application Data

(63) Continuation of application No. 14/213,883, filed on Mar. 14, 2014, now Pat. No. 9,409,392.

(30) Foreign Application Priority Data

Mar. 27, 2013 (JP) ..... 2013-067435

(51) Int. Cl.
*B41J 2/14* (2006.01)
*B41J 2/045* (2006.01)
*B41J 2/16* (2006.01)

(52) U.S. Cl.
CPC ..... *B41J 2/14201* (2013.01); *B41J 2/04581* (2013.01); *B41J 2/14* (2013.01);
(Continued)

(58) Field of Classification Search
CPC .. B41J 2/14201; B41J 2/04581; B41J 2/1607; B41J 2/14; B41J 2/14024; B41J 2202/19; B41J 2002/14306; B41J 2202/13
See application file for complete search history.

(56) References Cited

U.S. PATENT DOCUMENTS 6,227,651 B1 5/2001 Watts et al.
7,073,884 B2 7/2006 Ueda
(Continued)

FOREIGN PATENT DOCUMENTS

CN 102673154 9/2012
JP 11-147314 6/1999
(Continued)

OTHER PUBLICATIONS

European Search Report for Application No. 14161030.3 dated Jun. 17, 2014.

*Primary Examiner* — Yaovi M Ameh
(74) *Attorney, Agent, or Firm* — Workman Nydegger

(57) ABSTRACT

A wall-shaped enclosure that forms a space which can accommodate a head chip is formed in a projecting manner at a lower end of a lower case member. Since a cylindrical thick part is formed at the lower end of the lower case member, the lower case member is unlikely to be bent, particularly around the wall-shaped enclosure and a part where the wall-shaped enclosure is disposed. The head chip that is disposed in the space of the lower case member which is unlikely to be bent is unlikely to be subjected to an external force, and the cover member absorbs torsion generated between the head chip and the lower case member so that the head chip is even more unlikely to be subjected to the external force.

5 Claims, 11 Drawing Sheets

(52) U.S. Cl.
CPC ..... *B41J 2/14024* (2013.01); *B41J 2/1607* (2013.01); *B41J 2002/14306* (2013.01); *B41J 2202/13* (2013.01); *B41J 2202/19* (2013.01)

(56) References Cited

U.S. PATENT DOCUMENTS

| | | | | |
|---|---|---|---|---|
| 7,207,641 | B2 | 4/2007 | Komatsu et al. | |
| 8,292,409 | B2 | 10/2012 | Ueda | |
| 9,085,147 | B2 | 7/2015 | Watanabe | |
| 9,409,392 | B2 * | 8/2016 | Watanabe | B41J 2/14 |
| 2002/0024568 | A1 * | 2/2002 | Ito | B41J 2/14209 347/84 |
| 2003/0210307 | A1 | 11/2003 | Ito et al. | |
| 2003/0227516 | A1 | 12/2003 | Yamaguchi et al. | |
| 2004/0165028 | A1 | 8/2004 | Ito et al. | |
| 2006/0119647 | A1 | 6/2006 | Owaki et al. | |
| 2006/0164467 | A1 | 7/2006 | Shibuya et al. | |
| 2007/0070125 | A1 | 3/2007 | Watanabe | |
| 2007/0139488 | A1 | 6/2007 | Fujishiro | |
| 2007/0216740 | A1 | 9/2007 | Fukuda et al. | |
| 2008/0211868 | A1 | 9/2008 | Koseki | |
| 2009/0315946 | A1 | 12/2009 | Koseki | |
| 2011/0234701 | A1 | 9/2011 | Kobayashi et al. | |
| 2011/0237401 | A1 | 9/2011 | Kobayashi et al. | |
| 2012/0200638 | A1 | 8/2012 | Watanabe et al. | |
| 2012/0229570 | A1 | 9/2012 | Kobayashi et al. | |
| 2012/0242750 | A1 * | 9/2012 | Akahane | B41J 2/14233 347/47 |
| 2014/0015899 | A1 | 1/2014 | Akahane | |
| 2014/0292931 | A1 | 10/2014 | Watanabe | |
| 2015/0077472 | A1 | 3/2015 | Akahane | |

FOREIGN PATENT DOCUMENTS

| | | |
|---|---|---|
| JP | 2002-144590 | 5/2002 |
| JP | 2008-296533 | 12/2008 |
| JP | 2011-056872 | 3/2011 |
| JP | 2011-206922 | 10/2011 |
| JP | 2012-196882 | 10/2012 |

* cited by examiner

LIQUID EJECTING HEAD AND LIQUID EJECTING APPARATUS

BACKGROUND

1. Technical Field

The present invention relates to a liquid ejecting head that ejects a liquid from a nozzle, and a liquid ejecting apparatus and, more particularly, to a liquid ejecting head that ejects an ink as a liquid, and to a liquid ejecting apparatus.

2. Related Art

An ink jet type recording head (that is a representative example of a liquid ejecting head which ejects liquid drops) includes a pressure generation chamber that communicates with a nozzle and a piezoelectric actuator which is disposed to face the pressure generation chamber. A pressure change is generated in the pressure generation chamber by a displacement of the piezoelectric actuator so that the ink drops are ejected from the nozzle.

Various structures have been proposed as the structure of such ink jet type recording heads. In general, a plurality of members are set by using an adhesive or the like (for example, refer to JP-A-2011-56872).

In the structure of the ink jet type recording head shown in JP-A-2011-56872, a plurality of members that constitute a head chip are stacked, attached and set to a top of a case member. The respective members that are stacked on the top form an ink flow passage on an inner side surface.

In the structure of the ink jet type recording head shown in JP-A-2011-56872, the case member and the member that forms the ink flow passage on the inner side surface mainly have a directly fixed structure when the head chip is set to the case member. Thus, a force tending to peel the member fixed to the case member is generated when the case member is bent. Furthermore, ink leakage is likely to be caused if the member is the member which forms the ink flow passage on the inner side surface. Also, the same ink leakage is likely to be caused when the members are to be stacked on each other. Further, the head chip (which is smaller in size than in the related art) makes it difficult to ensure adhesive strength between the members. Even a slight distortion and bending of the case member (to which the head chip is set) and the head chip itself may cause ink leakage.

This disadvantage is present not only in ink jet type recording heads that eject ink but also in liquid ejecting heads that eject liquid other than ink.

SUMMARY

An advantage of some aspects of the invention is to provide a liquid ejecting head that is unlikely to cause liquid leakage, and a liquid ejecting apparatus.

According to an aspect of the invention, a liquid ejecting head includes a case member that has a communication path which causes ink to communicate from an upstream side to a downstream side, and a cover member in which a head chip is set, in which a wall-shaped enclosure that is disposed through integral molding with the case member to form a predetermined space inside is provided on a printing medium side of the case member, and the cover member is fixed to the case member in a part of the wall-shaped enclosure to contain the head chip in the predetermined space formed by the wall-shaped enclosure and the head chip communicates with the communication path in the predetermined space.

In the above-described configuration, the case member has the communication path which causes the ink to communicate from the upstream side to the downstream side, and the wall-shaped enclosure that is disposed through the integral molding with the case member to form the predetermined space inside is provided on the printing medium side of the case member. The head chip is set in the cover member, and the cover member is fixed to the case member in the part of the wall-shaped enclosure to contain the head chip in the predetermined space formed by the wall-shaped enclosure. Also, the head chip communicates with the communication path in the predetermined space.

According to the aspect of the invention, the head chip is disposed in the space of the case member that is unlikely to be bent, and the case member and the head chip are fixed by using the member that does not constitute the ink flow passage. As such, both the fixed part and the head chip itself are unlikely to be subjected to an external force and ink leakage can be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described in detail.

Figure 1:
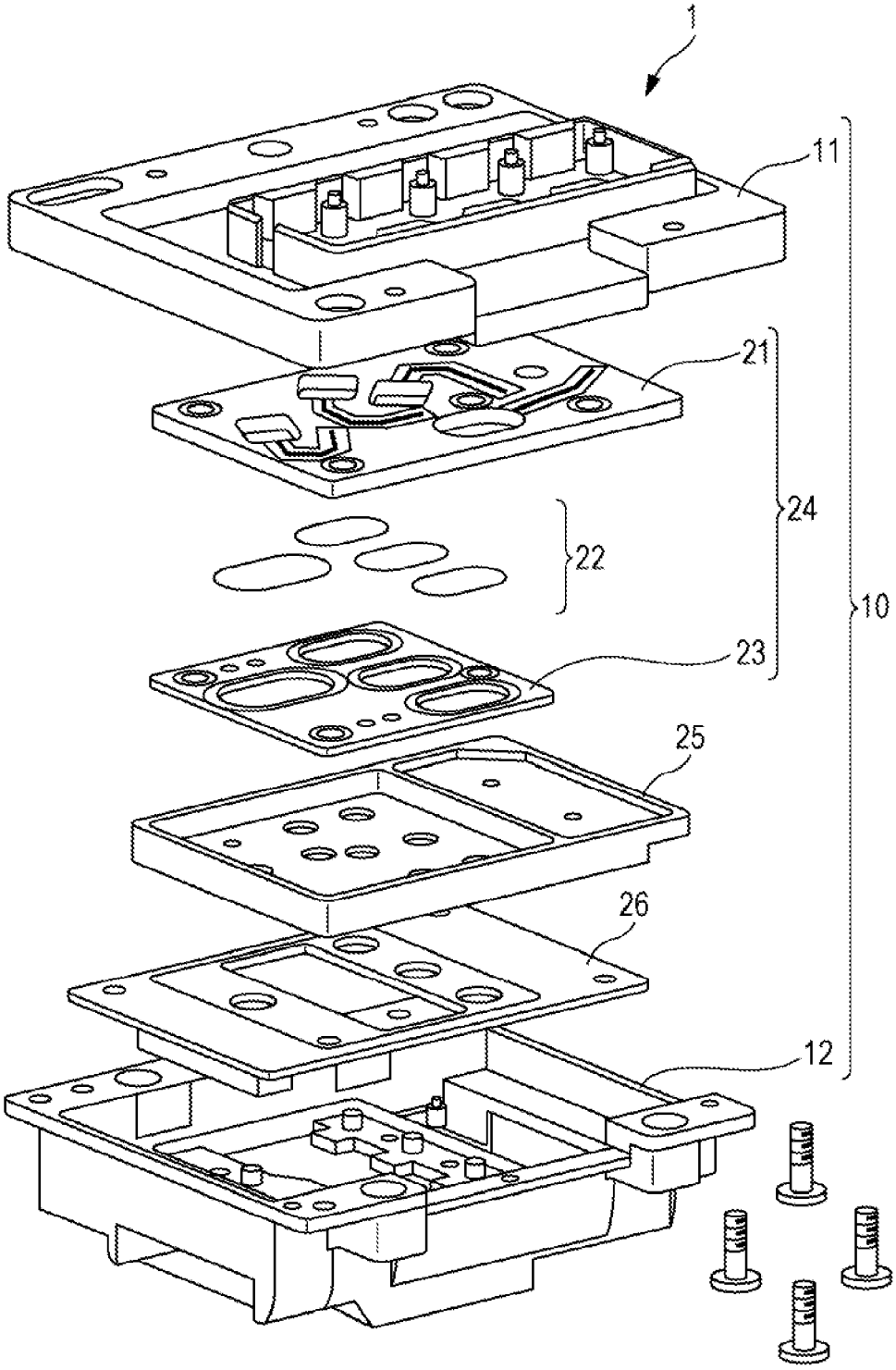
FIG. 1 is a development view of an upper side of a liquid ejecting head.
Figure 2:
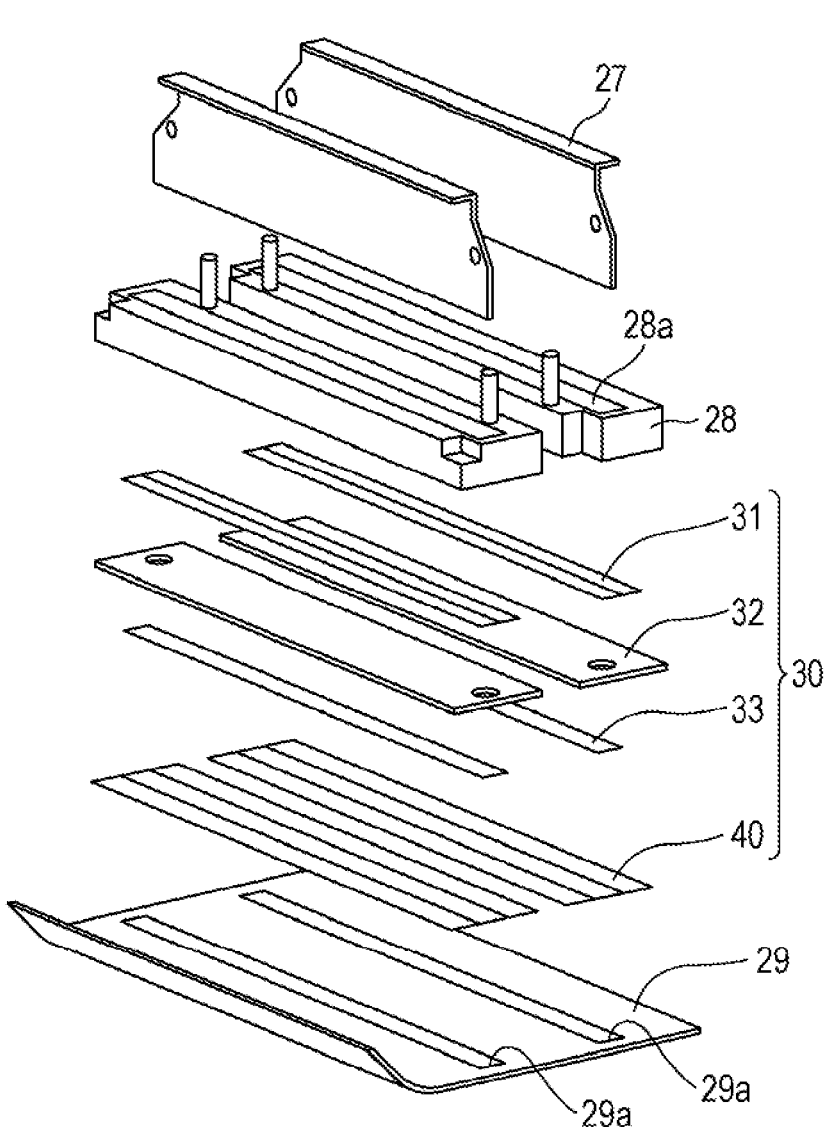
FIG. 2 is a development view of a lower side of the liquid ejecting head.
Figure 3:
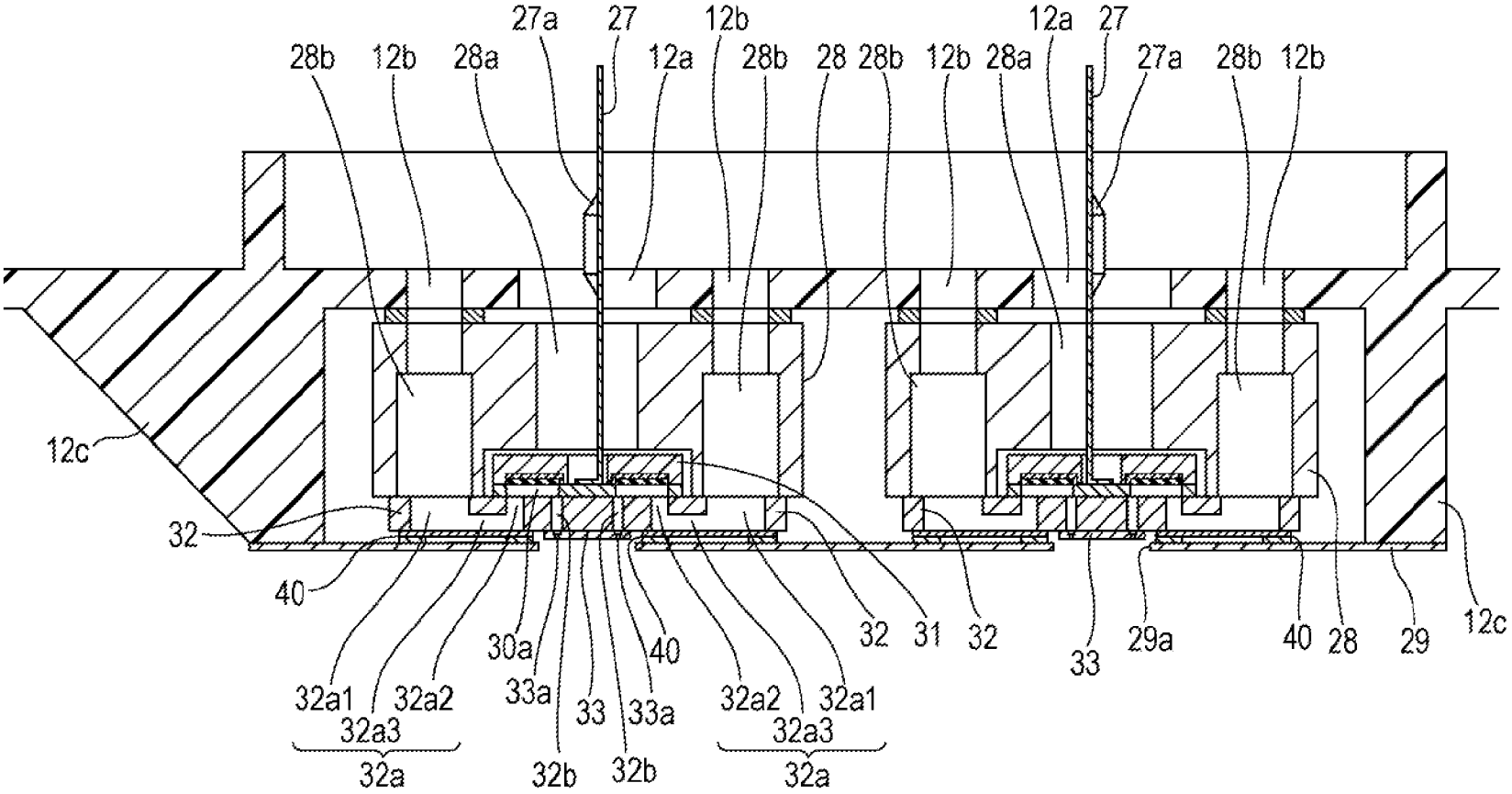
FIG. 3 is a cross-sectional view of the vicinity of a head chip.

FIGS. 1 and 2 are development views of an ink jet type recording head showing an example of a liquid ejecting head according to the embodiment of the invention. FIG. 3 is a cross-sectional view of the vicinity of a head chip of the ink jet type recording head.

As shown in FIGS. 1 and 2, an ink jet type recording head 1 is formed by accommodating respective parts in a case member 10 that has an upper case member 11 and a lower case member 12. An upper space and a lower space are formed in the lower case member 12. A flow path member 24 (that has a first flow path member 21, a filter 22, and a second flow path member 23), a seal member 25, and a circuit substrate 26 are sequentially stacked from above and are accommodated in the upper space.

Also, a flexible substrate 27, a third flow path member 28, a head chip 30, and a cover member 29 are accommodated from above in the lower space. The head chip 30 has a piezoelectric actuator part 31, a flow path forming plate 32, a nozzle plate 33, and a compliance member 40.

In the head chip 30, the piezoelectric actuator part 31 is fixed to an upper surface of the flow path forming plate 32, and the nozzle plate 33 and the compliance member 40 are fixed to a lower surface thereof. The flow path forming plate 32 is formed into a substantially rectangular plate shape. The piezoelectric actuator part 31 (which is formed into a substantially strip shape) is set on the upper surface of a central part of respective path forming plates 32 in a short direction. The piezoelectric actuator part 31 has pressure chambers 30*a* that are open downward. A ceiling wall of the pressure chamber 30*a* is bent in an up-down direction to allow a pressure change to be generated in the pressure chamber 30*a*.

An elastic membrane, an insulator film, and individual piezoelectric actuators (each of which having a first electrode, a piezoelectric body layer, and a second electrode) are formed in the ceiling wall of the pressure chamber 30*a*. In this context, the piezoelectric actuator part 31 refers to an integrated part in which a required number of the individual piezoelectric actuators are formed. Also, in this embodiment, the first electrode functions as an individual electrode that is independent of each of the piezoelectric actuators, and the second electrode functions as a common electrode that is common to a plurality of the piezoelectric actuators. Also, the first electrode is connected to one end of a lead electrode. A drive circuit 27*a* (which is formed on the flexible substrate 27) is connected to the other end of the lead electrode.

The two pressure chambers 30*a* are formed in the short direction, and a predetermined number thereof are formed in two rows, lined up in a longitudinal direction. The flexible substrate 27 that extends in the longitudinal direction is connected to a gap in the center between the two pressure chambers 30*a* and 30*a* which are lined up in the short direction. The flexible substrate 27 supplies driving power to the individual piezoelectric actuators of the two rows of the pressure chambers 30*a* and 30*a* which are positioned on both sides as described above. Each of the pressure chambers 30*a* faces a flow path 32*a* and a nozzle hole 32*b* that are formed on the flow path forming plate 32 on a lower surface thereof. Ink (which is a discharge liquid) is supplied from a flow path 32*a* side to the pressure chamber 30*a*, and the ink is pushed to a nozzle hole 32*b* side by the pressure change. The nozzle holes 32*b* and 32*b* are also arranged in a row, formed in two rows, in a longitudinal direction in the center of the short direction to correspond to the two rows of the pressure chambers 30*a*. Likewise, two rows of the flow paths 32*a* and 32*a* are formed on a short-direction outer side, arranged in a row. The pressure chamber 30*a* is set in a liquid-tight manner by an adhesive or the like on the flow path forming plate 32.

A flow path 32*a*1 and a flow path 32*a*3 of the flow path forming plate 32 are common communication paths, and a flow path 32*a*2 is an individual communication path. The upper surface is open at an outer-side inlet 32*a*1 and an inner-side outlet 32*a*2, and both thereof communicate with each other at the central flow path 32*a*3 that is open to the lower surface. The central flow path 32*a*3 is open on the short-direction outer side of the nozzle hole 32*b*, and thus the elongated central flow paths 32*a*3 and 32*a*3 are open to the outer side and the two nozzle holes 32*b* and 32*b* are open to the inner side thereof when the flow path forming plate 32 is viewed from below. These are formed to be lined up in the longitudinal direction.

The nozzle plate 33 is formed into a strip-like rectangular shape that extends in the longitudinal direction along the positions where the nozzle holes 32*b* and 32*b* of the flow path forming plate 32 are formed, and two nozzles 33*a* and 33*a* are formed to face the two nozzle holes 32*b* and 32*b*. The ink that is pushed to the nozzle hole 32*b* side by the pressure change in the pressure chamber 30*a* is discharged outside from the nozzle 33*a*. In other words, the liquid drops are discharged. The nozzle plate 33 is formed of an expensive silicon material. The nozzle 33*a* that is formed on the nozzle plate 33 is oriented downward.

The nozzle plate 33 is attached to the path forming plate 22 so as to be open along the positions where the nozzle holes 32*b* and 32*b* are formed, and thus the central flow paths 32*a*3 and 32*a*3 which are formed in two rows on an outer side thereof remain open. The nozzle plate 22 is covered by the compliance member 40.

Figure 4:
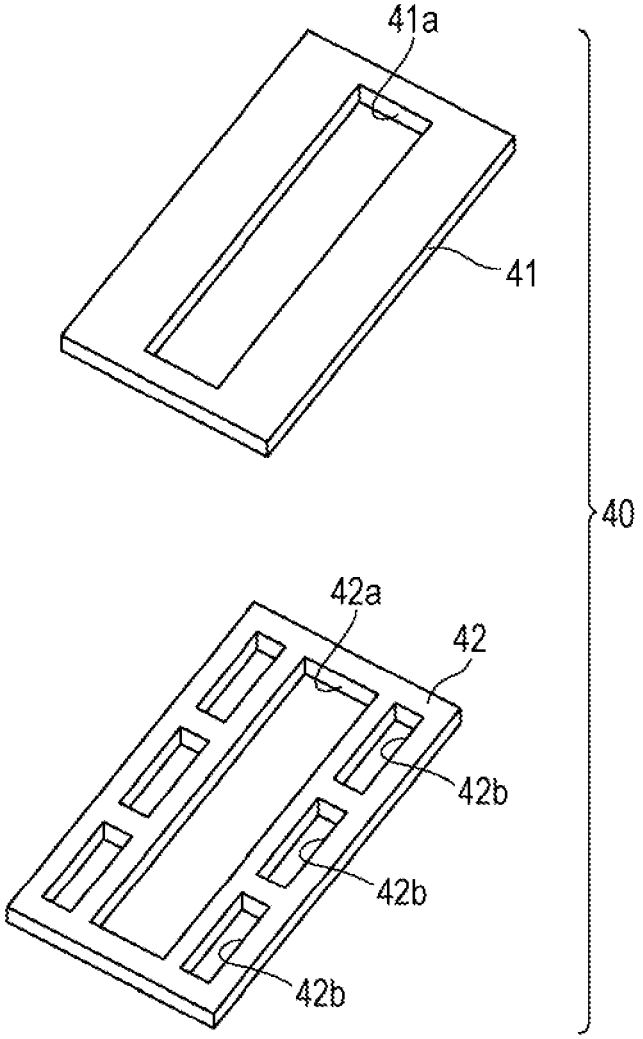
FIG. 4 is a schematic development view showing a configuration of a compliance member.

FIG. 4 is a schematic development view showing a configuration of the compliance member. The compliance member 40 is configured to have an elastic membrane 41 that is an elastic membrane member, and a frame material 42 that is a supporting body. The frame material 42 has a rectangular cut-out portion 42*a* in the center so as not to interfere with the nozzle plate 33, and two rows of three window sections 42*b* are formed to correspond to parts where the two rows of the central flow paths 32*a*3 and 32*a*3 are formed. The elastic membrane 41 is supported by a frame portion of the frame material 42 by attaching the elastic membrane 41 where a cut-out portion 41*a* is formed at a similar to the cut-out portion 42*a*. Through the attachment from an elastic membrane 41 side to the lower surface of the flow path forming plate 32, each of the central flow paths 32*a*3 is sealed by the elastic membrane 41. The window section 42*b* of the frame material 42 is formed on the side opposite to the elastic membrane 41, and the elastic membrane 41 can be flexurally deformed by the same amount as the thickness of the window section 42*b*. Also, a groove is formed in a part of the frame material 42 and a passage leading to the atmosphere is provided so that the window section 42*b* is not sealed, and thus the elastic membrane 41 is likely to be deformed. Accordingly, the compliance member 40 forms a series of communication paths by covering the central flow path 32*a*3 that reaches the outlet 32*a*2 from the inlet 32*a*1 from below, and achieves a function as the compliance member during the course thereof. A position where the compliance member 40 is mounted is not limited to the lower surface of the flow path forming plate 32, but may be the vicinity of the outlet 32*a*2 side. In this case, the central flow path 32*a*3 may be blocked by another member to form only the communication path and may maintain the function as the compliance member at the other part.

A wall-shaped enclosure 12*c* (that forms a space which can accommodate the head chip 30 and the third flow path member 28) is formed in a projecting manner at a lower end of the lower case member 12. The wall-shaped enclosure 12*c* projects in a cylindrical shape to form the space inside, and is formed to have a thickness larger than the thickness of the other wall surface of the lower case member 12. Since a cylindrical thick part is formed at the lower end of the lower case member 12, the lower case member 12 is unlikely to be bent, particularly around the wall-shaped enclosure 12*c* and a part where the wall-shaped enclosure 12*c* is disposed. Preferably, the wall-shaped enclosure 12*c* has a substantially square shape and a continuously linked cylindrical shape, but may not necessarily have the continuously linked shape. In other words, the wall-shaped enclosure 12*c* is effective in suppressing deformation or the like based on bending if disposed in a projecting manner through integral molding with the lower case member 12 so as to form a predetermined space inside.

The cover member 29 formed of stainless steel (that is thin enough to have elasticity) is fixed to and covers an opening that is formed in a projecting end section which is a top of the wall-shaped enclosure 12*c*. In the cover member 29, an elongated opening 29*a* that exposes the nozzle plate 33 to the lower surface is formed in a planar section along a printing medium. Herein, the head chip 30 and the cover member 29 are attached to and set in a compliance member 40 part of the head chip 30 in the planar section in the vicinity of the opening 29*a* of the cover member 29. That is, the cover member 29 is not attached to and set in a nozzle plate 33 part of the head chip 30 that constitutes an ink flow passage.

Also, the head chip 30 is fixed to a lower part of the lower case member 12 via the third flow path member 28. A through port 28*a* (which extends in a longitudinal direction) is formed in the center of the third flow path member 28. The flexible substrate 27 is inserted via the through port 28*a*. The third flow path member 28 has a space formed in the vicinity of a lower-side opening of the through port 28*a* so as to be capable of accommodating the piezoelectric actuator part 31. The third flow path member 28 also has a communication path 28*b* formed from an upper surface through a lower surface in a part other than the through port 28*a* so as to face the inlet 32*a*1 of the flow path 32*a* of the flow path forming plate 32. The third flow path member 28 and the flow path forming plate 32 are attached in a liquid-tight manner by an adhesive. According to the above-described configuration, communication is made from the communication path 28*b* to the pressure chamber 30*a* through the flow path 32*a* and, further, a series of ink passages are formed that lead to the nozzle 33*a* via the nozzle hole 32*b*.

The lower case member 12 has a through-hole 12*a* and a case member communication path 12*b* formed to correspond to the through port 28*a* and the communication path 28*b* of the third flow path member 28. The third flow path member 28 is fixed to the lower case member 12 from below the lower case member 12 by a flexible adhesive, which will be described later. In this case, the communication path 28*b* and the case member communication path 12*b* are set in such a manner as to communicate in a liquid-tight manner.

In this manner, the head chip 30 and the third flow path member 28 that are disposed in the space of the lower case member 12 (which is unlikely to be bent) are unlikely to be subjected to an external force. Further, the cover member 29 having elasticity absorbs torsion generated between the head chip 30 and the lower case member 12 so that the head chip 30 is even more unlikely to be subjected to the external force. As such, peeling by the members that constitute the head chip 30 can be suppressed and, in addition, ink leakage can be suppressed. Further, an adhesive having flexibility is even more effective during the fixing of the head chip 30 and the third flow path member 28 (i.e., the members that constitute the ink flow passage).

The position of the wall-shaped enclosure 12*c* where the cover member 29 is fixed is not limited to the opening on the top of the wall-shaped enclosure 12*c* as described above, but may be inner and outer side surfaces of the wall-shaped enclosure 12*c*. Also, the material of the cover member 29 is not limited to stainless steel, but the cover member 29 may be a member having elasticity.

The nozzle plate 33 is formed to be thinner than the compliance member 40. Accordingly, the nozzle plate 33 has a positional relationship of not projecting to a further outer side than the cover member 29 when positioned in the opening 29*a*. Also, the nozzle plate 33 that is formed of silicon with high precision is expensive, and thus is attached in such a manner as to cover only a necessary part so as to be small in size and exposure from the opening 29*a* of the cover member 29 is suppressed to a minimum. The head chip 30 and the cover member 29 are attached to and set in the planar section in the vicinity of the opening 29*a* of the cover member 29 not in a part of the nozzle plate 33 but in a part of the compliance member 40.

In this manner, in the nozzle plate 33 that constitutes the ink flow passage of the head chip 30, a possibility of contact with the printing medium is suppressed to a minimum. Further, the printing medium is in contact with the cover member 29 that does not constitute the ink flow passage. As such, peeling in the member that constitutes the ink flow passage can be suppressed and, in addition, ink leakage can be suppressed.

Figure 5:
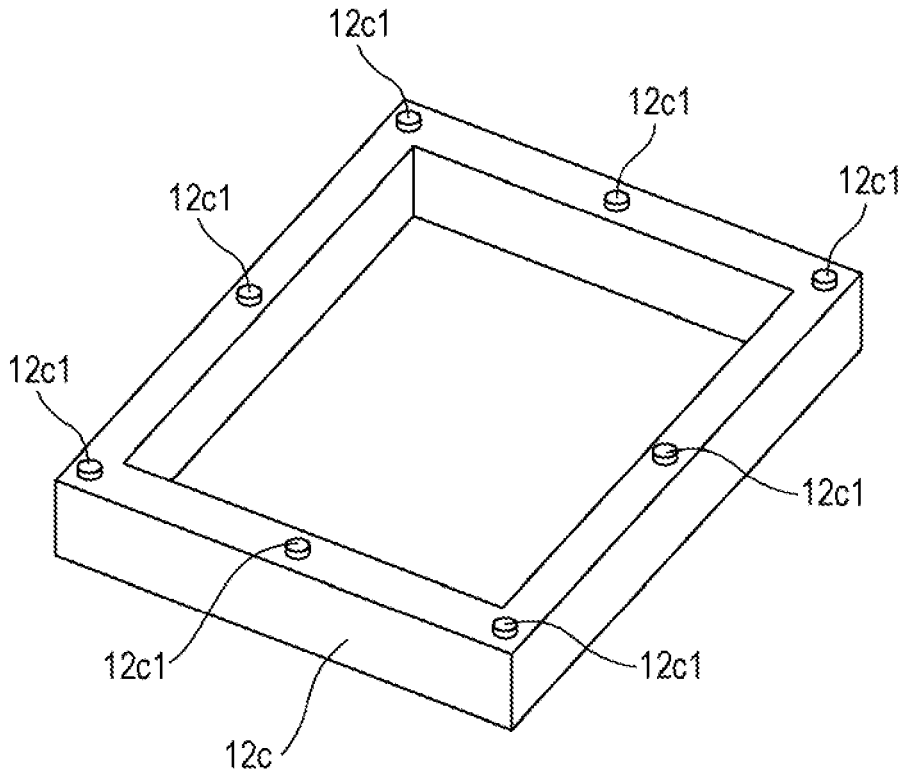
FIG. 5 is a schematic perspective view showing a bottom side of a case member.
Figure 6:
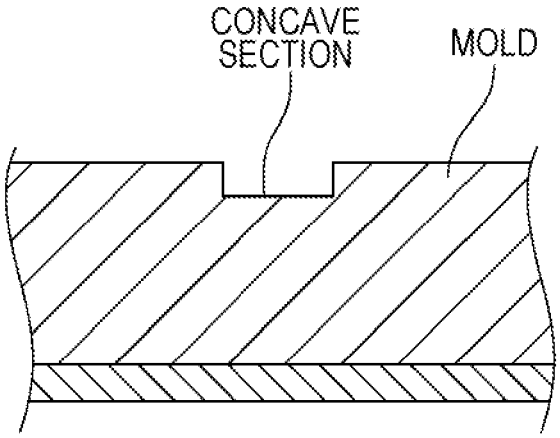
FIG. 6 is a cross-sectional view of a main part of a mold.
Figure 7:
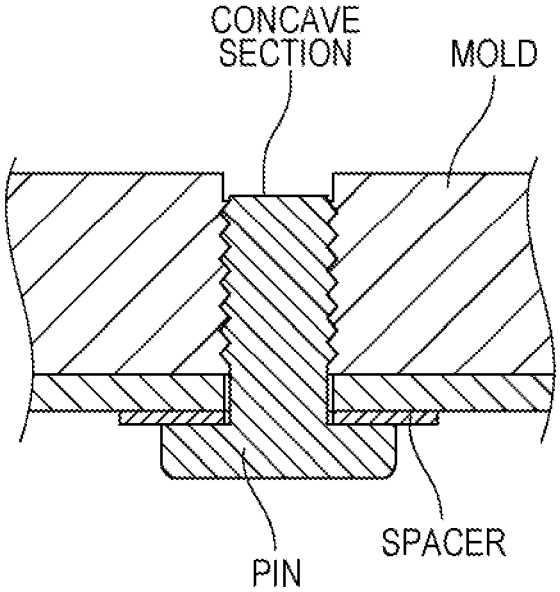
FIG. 7 is a cross-sectional view of the main part of the mold.

FIG. 5 is a schematic perspective view showing a bottom side of the lower case member. FIGS. 6 and 7 are cross-sectional views of a main part of a mold that forms the lower case member.

The wall-shaped enclosure 12*c* is formed to be thick as described above. The lower case member 12 itself is an article integrally molded by a resin and, in many cases, a thick part thereof cannot maintain the accuracy as designed due to an effect of contraction during cooling of the resin. This does not mean the presence of individual irregularities but the generation of a larger scale shift in the entire wall-shaped enclosure 12*c* which is molded. Even when the top of the wall-shaped enclosure 12*c* is intended to form a plane in design, the entire molded article may vary from being planar, even if only slightly, due to shrinkage of the resin and the contraction of the resin during the molding. As stated above, finishing to form a plane across the entire top of the wall-shaped enclosure 12*c* is not easy.

In this embodiment, a plurality of projections 12*c*1 are formed apart from each other in the top portion of the wall-shaped enclosure 12*c*. Specifically, the projections 12*c*1 are formed in eight places in total including four corners of the wall-shaped enclosure 12*c* with a substantially rectangular cross section and four places in the middle of each side. As a result, the top of each side of the wall-shaped enclosure 12*c* is a position where the projection 12*c*1 projects the most. The respective projections 12*c*1 do not have a uniform height from the top portion of the wall-shaped enclosure 12*c*. First, the lower case member 12 that has no projection 12*c*1 is molded. Then, the position of the top of the wall-shaped enclosure 12*c* is measured. Then, it is determined how much to raise the top of the wall-shaped enclosure 12*c* while assuming a plane that is parallel with the plane formed by the head chip 30 when the third flow path member 28 (which holds the head chip 30) is set in the lower case member 12. When the height of each raising is determined for the eight positions described above, concave portions corresponding to the respective heights are formed on a mold side as shown in FIG. 6. Forming the concave portions on the mold side in this manner is easier than raising the inner portion. Also, finishing accuracy can be selected adequately.

Accordingly, the plane (that is formed by the top of the projection 12*c*1 of the wall-shaped enclosure 12*c*) can satisfy an intention of a designer by forming the concave portions of the mold with required accuracy and using this mold. When the lower case member 12 is put upside down in this state and the cover member 29 is mounted from above the wall-shaped enclosure 12*c* in a state where the head chip 30 is set, the cover member 29 abuts against the top of the projection 12*c*1 and is maintained in a plane without being affected by the non-planar shift inevitably generated in the wall-shaped enclosure 12*c* as described above. In a case where a plurality of the head chips 30 are set in the cover member 29, each of the head chips 30 can be arranged with high positional accuracy below the lower case member 12 since the plane is maintained. In this case, the cover member 29 does not necessarily have to be in contact with the projection 12*c*1 in a strict sense. Rather, it is allowable for the cover 29 to abut against many of the projections 12*c*1 although perhaps being out of contact with a small number of the projections 12*c*1, so long as the expected plane is maintained. Also, since the cover member 29 itself is initially attached to and set in the lower case member 12 by using the adhesive applied to the top of the wall-shaped enclosure 12*c*, the adhesive may be interposed between the projection 12*c*1 and the cover member 29 so that the projection 12*c*1 and the cover member 29 are not in contact with each other in a strict sense.

In a case where the projection 12*c*1 is disposed on a cover member 29 side, and not on a wall-shaped enclosure 12*c* side, there is a concern that distortion may occur in the cover member 29 during a process in which the projection 12*c*1 is formed in the cover member 29 to deteriorate the planarity property. As such, the projection 12*c*1 may be disposed on the wall-shaped enclosure 12*c* side.

When the concave portion is formed by using a drill as shown in FIG. 6 during the formation of the projection 12*c*1, the top of the projection 12*c*1 is molded in a conical shape in many cases. In this case, abutting against the cover member 29 is made in a state of being close to a point. Alternatively, FIG. 7 shows an example in which the concave portion is formed by using a so-called pin. The pin, in general, has a configuration in which a male screw is screwed into a female screw hole. When the male screw is screwed deeply with a female screw, the concave portion becomes shallow inside the mold and the projection 12*c*1 is formed to be short. In contrast, when the male screw is screwed shallowly into the female screw, the concave portion becomes deep inside the mold and the projection 12*c*1 is formed to be long. If a spacer having a constant thickness is prepared in advance so as to determine the length, the length of each of the projections 12*c*1 can be freely adjusted.

The minimum required number of the projections 12*c*1 is three if the plane is to be identified. However, one thereof can be provided by a part of the wall-shaped enclosure 12*c*. Also, irregularities in the amount of the applied adhesive can be reduced as well through precise calibration of the rising in the projection 12*c*1. Also, it is preferable that the number of the projections 12*c*1 exceed three so as to prevent the cover member 29 from being bent due to a wide gap between the projections 12*c*1. Considering that the cover member 29 has a substantially square shape, formation at the eight places including the four corners of the wall-shaped enclosure 12*c* and the middle points thereof provides stability.

Figure 8:
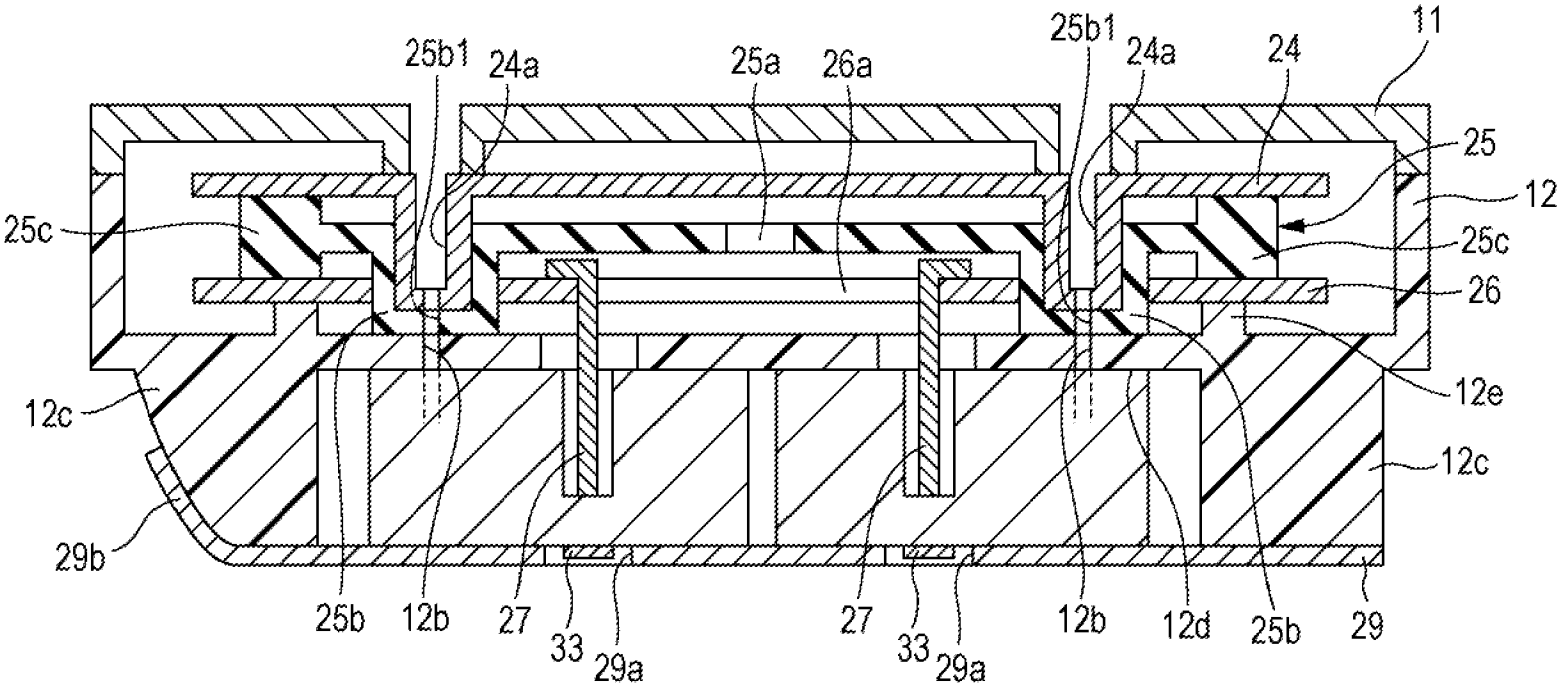
FIG. 8 is a schematic cross-sectional view showing an overall internal configuration of the case member.
Figure 9:
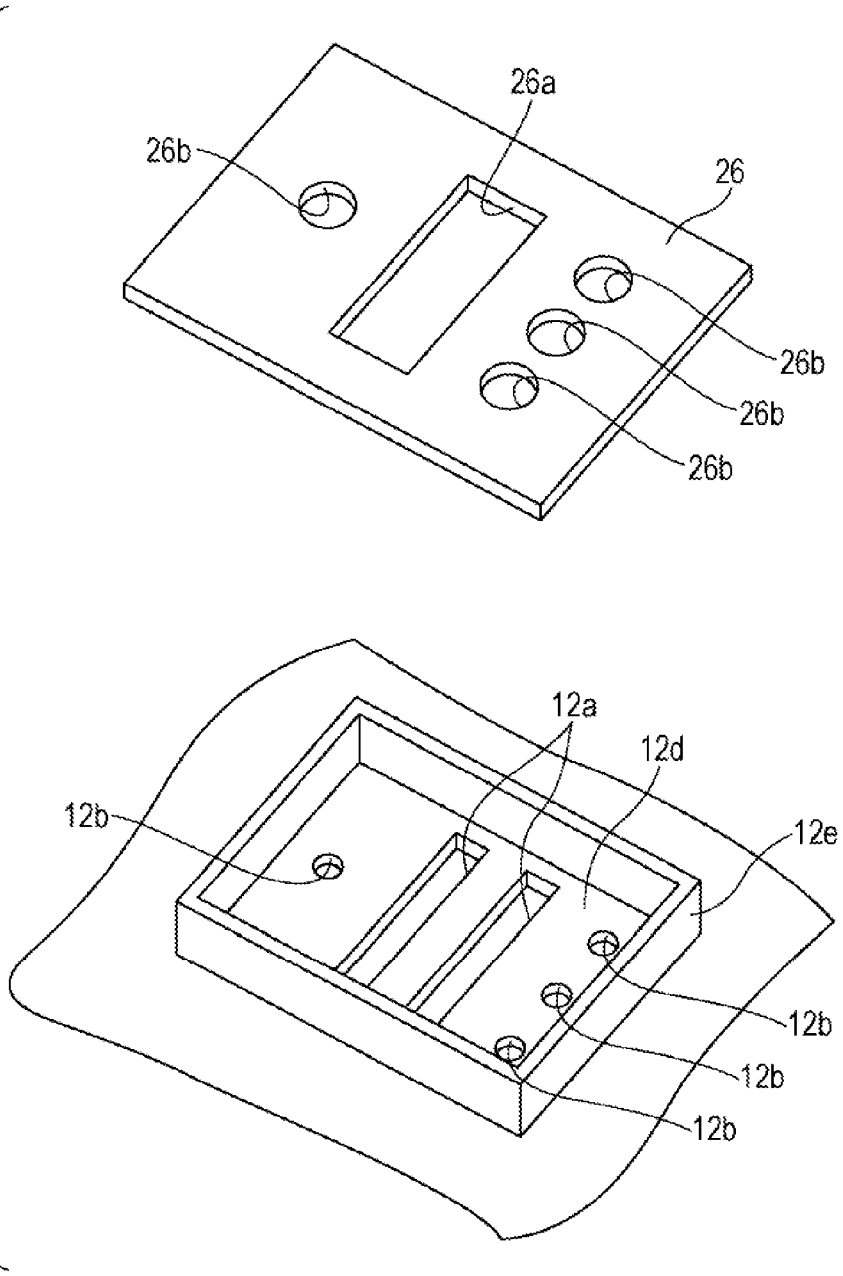
FIG. 9 is a schematic perspective view showing the overall internal configuration of the case member.

Next, FIG. 8 is a schematic cross-sectional view showing an overall internal configuration of the case member, and FIG. 9 is a schematic perspective view showing the overall internal configuration of the case member.

The lower case member 12 forms a predetermined accommodating space on a side above a bottom wall 12*d* where the through-hole 12*a* and the case member communication path 12*b* are formed when combined with the upper case member 11. An inner rib 12*e* that has a rectangular cross section is formed in a projecting manner upward from the bottom wall 12*d*. The through-hole 12*a* and the case member communication path 12*b* are formed on a further inner side of the bottom wall 12*d* than the inner rib 12*e*. The circuit substrate 26 is mounted on a top of the inner rib 12*e*, and the seal member 25 and the flow path member 24 are mounted thereon. The top of the inner rib 12*e* identifies a plane that can be in close contact with the circuit substrate 26. The top, in this sense, forms a planar section and the circuit substrate is mounted on the planar section.

The circuit substrate 26 has an external shape that is larger than the inner rib 12*e*, and the top of the inner rib 12*e* abuts continuously against a lower surface of the circuit substrate 26 in a state where the circuit substrate 26 is mounted on the inner rib 12*e*. The part where the top of the inner rib 12*e* and the circuit substrate 26 abut against each other is hermetically fixed by applying in advance a predetermined amount of a hermetic adhesive to the top of the inner rib 12*e* prior to abutting against each other. The inner rib 12*e* itself is a three-dimensional cylindrical object and the planar circuit substrate 26 is attached to and set in the planar section formed in the opening thereof so that rigidity of the entire lower case member 12 can be increased around the inner rib 12*e*. The circuit substrate 26 is a print substrate, and multiple leads which are electrically connected to the flexible substrate 27 are formed in an edge portion of a through port 26*a*. Also, a lead terminal (not shown) is formed in an outer edge portion as well, and is electrically connected to the outside via a connector.

Through ports 26*b* are formed at a position on the circuit substrate 26 which corresponds to the respective case member communication paths 12*b* of the lower case member 12. In this case, the through ports 26*b* are formed at the position that corresponds to the case member communication paths 12*b* and the case member communication paths 12*b* are in a state of being exposed in an up-down direction. The case member communication path 12*b* communicates with the communication path 28*b* of the third flow path member 28 through a passage (not shown) as described above.

The seal member 25 (which is formed from a rubber material, for example an elastomer) has an external shape which is smaller than the external shape of the circuit substrate 26. However, the seal member 25 has an external shape which is larger than an area including the through port 26*a* and the through port 26*b*, and has a small through port 25*a* formed in the center thereof. Also, a convex part 25*b* (that projects downward and is formed into a cup shape) is formed at a position corresponding to each of the through ports 26*b* of the circuit substrate 26. The convex part 25*b* is fitted into an inner circumferential surface of the through port 26*b* on an outer circumferential surface of a cup-shaped cylindrical part to fulfill a positioning function when inserted into the through port 26*b* of the circuit substrate 26. A cup-shaped bottom surface abuts against a circumferential edge portion of the opening of the case member communication path 12*b*. A through port 25*b*1 is also formed in the bottom surface to form a communication passage communicating with the case member communication path 12*b*.

A continuous seal part 25*c* whose thickness continuously increases upward and downward is formed on a circumferential edge of the seal member 25. A lower surface of the continuous seal part 25*c* is in close contact with an upper surface of the circuit substrate 26 and an upper surface thereof is in close contact with a lower surface of the flow path member 24 when the flow path member 24 is mounted on the seal member 25. A cylindrical communication path 24*a* that corresponds to the convex part 25*b* of the seal member 25 and projects downward is formed in the flow path member 24. The length thereof is equivalent to the length of a lower end of the communication path 24*a* in contact with the bottom surface in the convex part 25*b* when the flow path member 24 is mounted on the seal member 25 and is in contact with the continuous seal part 25*c*. The flow path member 24 is accommodated in such a manner as to be pressed downward in the lower case member 12. In this case, the flow path member 24 abuts against the continuous seal part 25*c* in a circumferential edge part and the communication path 24*a* abuts against the bottom surface in the convex part 25*b*. Also, the continuous seal part 25*c* of the seal member 25 continuously abuts against the circumferential edge part of the circuit substrate 26 on a lower surface thereof and a lower surface side of the bottom surface of the convex part 25*b* abuts against the circumferential edge portion of the opening of the case member communication path 12*b*. When a predetermined pressing force is added from the flow path member 24, the seal member 25 achieves a sealing function in the abutting part in the above-described manner.

Herein, the communication path 24*a* of the flow path member 24 corresponds to a first communication path, the case member communication path 12*b* corresponds to a second communication path, and the communication path 28*b* of the third flow path member 28 corresponds to a third communication path. In FIG. 8, the communication path 28*b* is not shown for simplicity. An opening in which a predetermined space is formed inside by the wall-shaped enclosure 12*c* is formed on a printing medium side of the lower case member 12, and the third flow path member 28 in a state where the head chip 30 is held is set in the lower case member 12 in the predetermined space. The opening is blocked in a state where a nozzle surface of the head chip 30 is exposed to the outside by the cover member 29. Further, the seal member 25 (which causes the first communication path and the second communication path to communicate with each other in a liquid-tight manner) is interposed between the flow path member 24 and the lower case member 12 via the circuit substrate 26 in a stacking direction of the flow path member 24. The sealing member thus seals an opening-side space in the lower case member 12. In other words, a liquid-tight structure can be easily formed in a predetermined part just through stacking with the seal member 25 being interposed. Compared to a case where the seal member is formed by separate bodies, the formation of the integrated seal member is likely to result in a reduction of the size of the entire seal member and an improvement in assemblibility because the number of components is reduced.

In this case, since the through port 25*a* is formed in the seal member 25, the space generated between the seal member 25 and the flow path member are sealed, as well as the space on a lower side of the seal member 25. Also, a narrow grooved path open to the atmosphere is formed on an upper surface of the continuous seal part 25*c*. This allows an inner circumferential side and an outer circumferential side to communicate with each other on the upper surface of the continuous seal part 25*c*. In other words, the path open to the atmosphere is formed into a groove-shaped part that is formed in a close contact surface in the stacking direction.

A large amount of gas does not move in and out because the groove shape is significantly narrow. Rather, but a very small amount of gas moves in and out. In the invention, a sealed state is obtained where the movement of this amount of gas is allowed. This is used so that the very small pressure change generated during a displacement of the above-described compliance member 40 is transmitted to the outside for opening.

In this embodiment, the flow path member 24 is covered by the upper case member 11, and an ink cartridge (not shown) that is a holding member for the discharge liquid is mounted and set on the upper case member 11. The passage reaching the flow path member 24 from the ink cartridge via the upper case member 11 also has to be a liquid-tight communication path. For instance, in this embodiment, a liquid-tight structure using an O-ring (not shown) or the like is formed. Also, the upper case member 11 is screwed to and set in the lower case member 12 from a lower side of the case. Furthermore, a pressing force is generated downward in the above-described stacking direction by the flow path member 24 when the upper case member 11 approaches the lower case member 12 to be fastened.

Even when the seal member 25 is pinched and fastened by screwing between the upper case member 11 and the lower case member 12 in this manner, the planar substrate that is attached to and set in the above-described wall-shaped enclosure 12*c* and further the inner rib 12*e* effectively suppresses the bending generated in the lower case member 12. During the assembly of the seal member 25 between the upper case member 11 and the lower case member 12, a cumbersome operation in which an adhesive is used is not necessary. Rather, simple compression pinching allows the assembly with simplicity.

The communication paths for the ink that reaches the head chip 30 from the ink cartridge are the communication path 24*a* (first communication path) of the flow path member 24, the case member communication path 12*b* (second communication path), and the communication path 28*b* (third communication path) of the third flow path member 28 as described above. Since the ink is supplied to the head chip 30 through the flow path in each of the members accommodated in the internal space formed by the upper case member 11 and the lower case member 12, the ink is not easily dried. However, in the part that is set by using the adhesive, consideration for easy drying is required depending on gas barrier properties of the adhesive. In a case where the head chip 30 is smaller in size than in the related art, an effect of thickening of the ink by drying becomes significant because the absolute amount of the ink held inside is small. In this embodiment, a modified epoxy resin is used as the adhesive considering the flexibility. The peeling is unlikely to be generated by using the adhesive having flexibility in fixing the members with each other. The modified epoxy resin has high flexibility but low gas barrier properties, and thus moisture contained in the ink is permeated outside to cause the thickening of the ink. However, as described above, the head chip 30 or the like is held in the space that is sealed by the seal member 25 and the sealed space is filled with the permeated moisture so that more permeation is unlikely to occur and the structure becomes resistant to the thickening. Also, the flow path formed from the first communication path and the second communication path described above is identified inside the case member surrounded by the upper case member 11 and the lower case member 12. Accordingly, a flow path is formed for the discharge of liquid from an upstream side corresponding to the ink cartridge toward a downstream side corresponding to the third communication path.

In a case where printing is performed with a liquid ejecting apparatus on which the liquid ejecting head is mounted, it is preferable to clean the nozzle surface at a certain frequency. Cleaning by wiping contamination on the surface is performed with a wiper formed from an elastic material.

Figure 10:
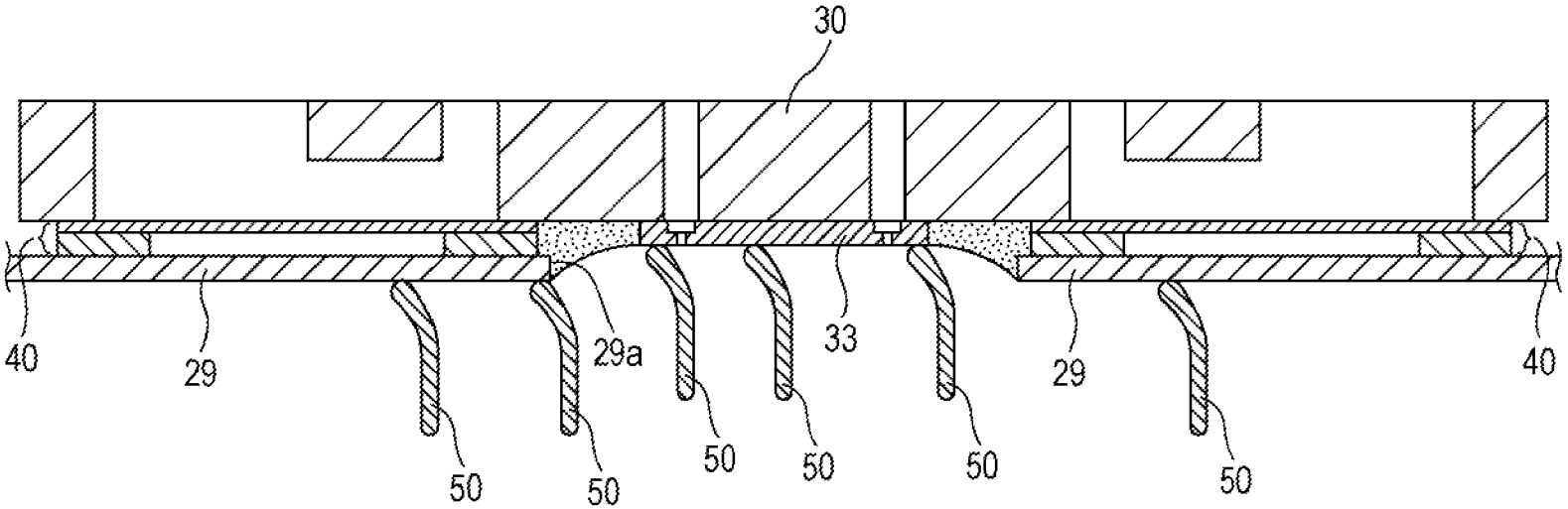
FIG. 10 is a schematic cross-sectional view showing a wipe process.

FIG. 10 is a schematic cross-sectional view showing the wipe process.

As described above, the nozzle plate 33 is held in the opening 29*a* of the cover member 29 at a position further recessed than the surface of the cover member 29.

A wiper 50 is set at a position shifted from a printing area within a range of main scanning of the liquid ejecting head, and a top of the wiper 50 wipes the cover member 29 and the surface of the nozzle plate 33 as the liquid ejecting head is relatively moved with respect to the wiper 50 and a wiping part of the wiper 50 wipes the ink remaining on both of the surfaces. This operation is referred to as wiping. As shown in FIG. 10, a top-sided part of the wiper 50 is moved to slide upward as a first step when moving from the almost flat surface of the cover member 29 to the surface of the nozzle plate 33 in the opening 29*a*. Further, the top-sided part of the wiper 50 is moved to slide downward as a second step when finishing the surface of the nozzle plate 33 and moving back to the surface of the cover member 29. When the step parts are not smoothly continuous, the ink or the like that is collected on the top of the wiper 50 is captured in a non-continuous part, and the liquid ejecting head may not be clean.

In this embodiment, the step generated between the nozzle plate 33 and the cover member 29 is filled with a filling material so that the surfaces are smoothly connected with each other.

Figure 11:
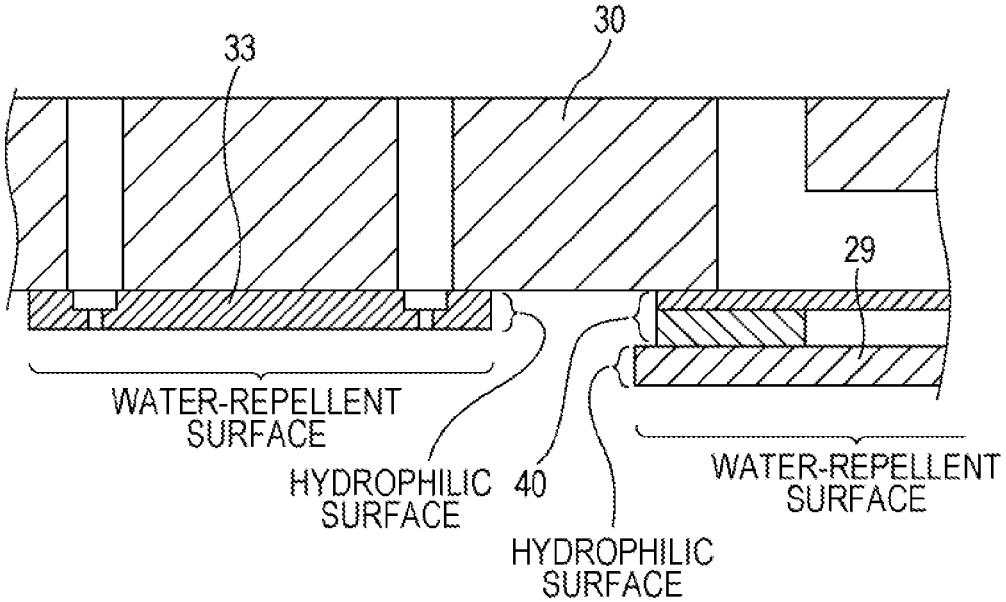
FIG. 11 is a schematic cross-sectional view showing a nozzle plate and a cover member.
Figure 12:
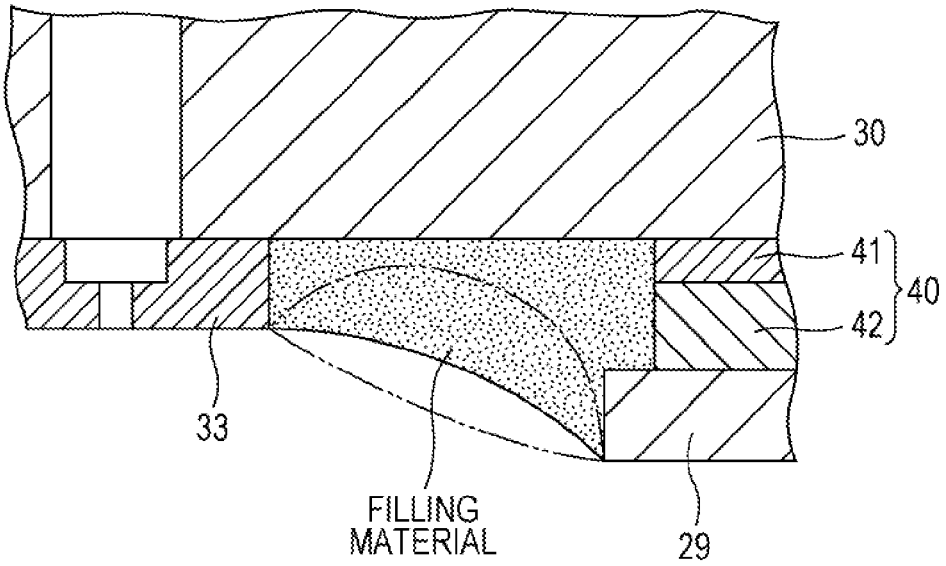
FIG. 12 is a schematic cross-sectional view showing a state where the amount of a filling material differs.

FIG. 11 is a schematic cross-sectional view showing the nozzle plate and the cover member. FIG. 12 is a schematic cross-sectional view showing a state where the amount of the filling material differs.

The space filled with the filling material is a part surrounded by a side surface of the nozzle plate 33, a lower surface of the head chip 30, a side surface of the compliance member 40, and an extremely small part of a lower surface and the side surface of the cover member 29. When the amount of the filling material is large, overflowing is caused and a filling agent may capture the ink. Meanwhile, when the amount of the filling material is small, permeation is not made in a part where the permeation is required and the concave portion is formed so that the concave portion may capture the ink. Also, when the amount of the filling material is small, the side surface of the nozzle plate 33 is in an exposed state. Since the nozzle plate 33 is formed of silicon as described above and is vulnerable to static electricity, there is a concern that the nozzle plate 33 is electrostatically broken down. Accordingly, the filling material is filled by an amount less than a predetermined amount and, as shown in FIG. 11, both or at least one of the surfaces and the side surfaces is subjected to a coating treatment so that the surfaces of the lower surfaces of the nozzle plate 33 and the cover member 29 become water-repellent surfaces and the surfaces of the side surfaces of the nozzle plate 33 and the cover member 29 become relatively hydrophilic surfaces with respect to the surfaces of the lower surfaces. Then, when the small amount of the filling material begins to fill the space, the filling material is spread on the hydrophilic surfaces of the side surfaces of the nozzle plate 33 and the cover member 29. Accordingly, when the amount of filling material is not sufficient, the filling material still creeps up the side surfaces in such a manner as to cover the entire side surfaces. The spreading is made in the so-called principle of surface tension. The spreading is initiated from when the amount of the filling material is small.

In FIG. 12, the solid line shows the optimum designed amount of the filling material. However, even in a case shown with the dashed line where the amount of the filling material is small, the filling material spreads up the hydrophilic surfaces of the side surfaces of the nozzle plate 33 and the cover member 29. Accordingly, a gap or the like caused by insufficient filling material does not occur along at least the side surfaces of the nozzle plate 33 and the cover member 29. Also, the specified amount is to the extent of being slightly recessed than the straight line linking edge portions of the surfaces of the nozzle plate 33 and the cover member 29 with each other. This state is a state where an exposed part of the filling material forms a slightly recessed surface. Even when the filling is made to exceed a necessary amount in a rare case, the surfaces of the nozzle plate 33 and the cover member 29 are treated to be water-repellent and thus the filling material does not spread along these surfaces.

Also, epoxy and an adhesive can be applied as the filling material, but examples thereof are not limited thereto.

In other words, when the lower surface of the liquid ejecting head is formed by the nozzle plate 33 and the cover member 29, the surface of the nozzle plate 33 and the surface of the cover member 29 are the water-repellent surfaces. Furthermore, the side surfaces of the nozzle plate 33 and the cover member 29 are relatively hydrophilic surfaces compared to the surfaces and the gap between the nozzle plate 33. Also, the cover member 29 is filled with the filling material. If at least the side surface of the nozzle plate 33 is covered by the filling material, the nozzle plate 33 can be protected from static electricity. Further, if the side surface of the cover member 29 is covered by the filling material, wiping by the wiper 50 is improved.

Figure 13:
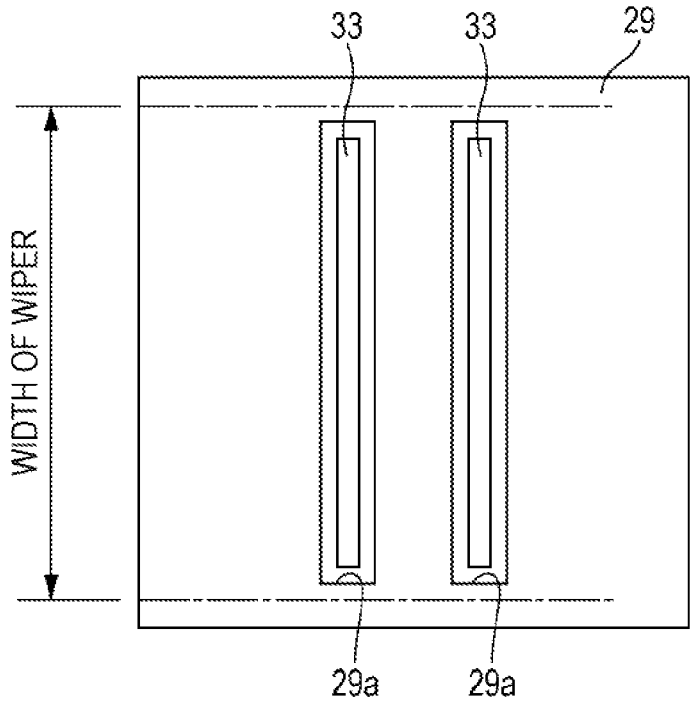
FIG. 13 is a schematic bottom view showing a state where the cover member is viewed from below.
Figure 14:
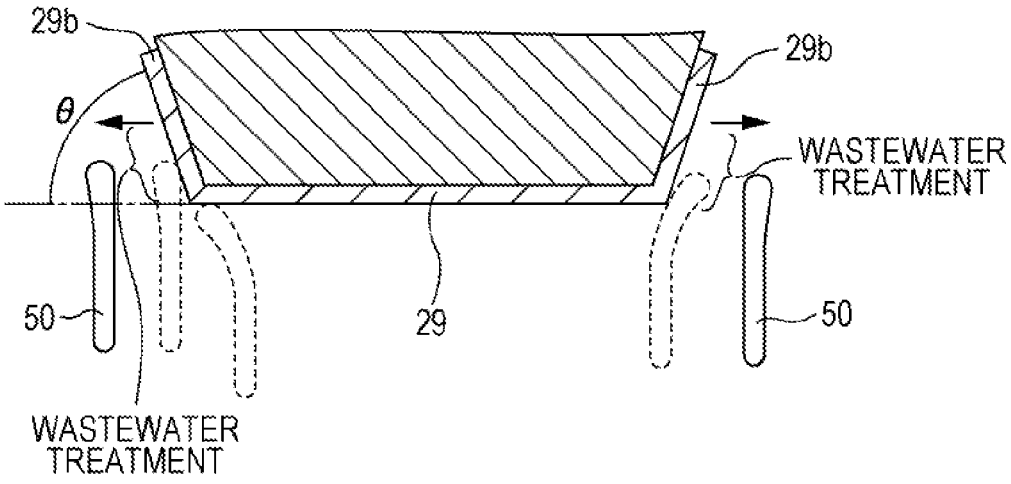
FIG. 14 is a schematic side view showing a state where the cover member and a wiper abut against each other.

FIG. 13 is a schematic bottom view showing a state where the cover member is viewed from below. FIG. 14 is a schematic side view showing a state where the cover member and the wiper abut against each other.

The nozzle plate 33 has a strip-like long shape, and the above-described gap is generated along each of the two sides of the long side and the short side. The nozzle 33*a* is formed along the long side direction and the liquid ejecting head has a direction orthogonal to the long side. The wiper 50 is moved in a direction orthogonal to the relative long side, and the ink is likely to enter the gap on the long side. In this sense, it is effective to render the step of the surface smooth by using the above-described filling agent in a direction crossing the direction in which the liquid ejecting head is moved.

In order for the wiper 50 to effectively wipe the surfaces of the cover member 29 and the nozzle plate 33, the wiper 50 itself has to have elasticity and the distance between the wiper 50 and both thereof has to have a positional relationship to the extent of the wiper 50 being bent while abutting. The liquid ejecting head is driven when the wiper 50 has the length to the extent of being bent. Accordingly, an end section of the cover member 29 begins to abut against the wiper 50.

In this embodiment, an end section part of the cover member 29 is bent across a predetermined length toward the wiping direction, and an angle θ of the lower surface with respect to the plane is 45° to 80°. As shown in FIG. 14, when the liquid ejecting head is driven and the wiper 50 begins to abut relatively against the end section of the cover member 29, the top of the wiper 50 first abuts against a bent end section 29*b* of the cover member 29. Then, the top of the wiper 50 is gradually bent and wipes the lower surface of the cover member 29 and the surface of the nozzle plate 33 described above to wipe the contamination such as the ink. The wiped ink gradually remains on the surface of the wiper 50, and the ink that remains on the wiper 50 is likely to be attached to the vicinity of the bent end section 29*b* against which the wiper 50 abuts first. Accordingly, the water-repellent treatment is performed in advance in both the wiper 50 and in the vicinity of the bent end section 29*b* so that the ink is likely to come off naturally before being gradually attached to the wiper 50 or before the attached ink is moved to the bent end section 29*b* to be accumulated. Also, the water-repellent treatment may be performed across the entire surface of the cover member 29, but the above-described effect can be obtained if the water-repellent treatment is performed in the part where the wiper 50 first abuts against the bent end section 29*b* and the vicinity thereof. Also, the ink is likely to come off following the water-repellent treatment when the bent end section 29*b* has an angle of 45° to 80°. Also, although FIG. 14 is a schematic view, the bent end section 29*b* is disposed on both sides based on the direction in which the liquid ejecting head is driven. In this case, the wiping of the cover member 29 and the nozzle plate 33 can be performed effectively on the surface on the side opposite to the wiper 50 when the liquid ejecting head passes through the holding position of the wiper 50 and is reversed again.

Also, the invention is not limited to the above-described embodiment, but the followings are appreciated by those skilled in the art as an embodiment of the invention.

The mutually replaceable members, configuration, and the like disclosed in the above-described embodiment can be applied through an appropriate change in combination thereof.

Although not disclosed in the above-described embodiment, the members, configuration, and the like disclosed in the above-described embodiment as the related art and the mutually replaceable members, configuration, and the like can be applied through an appropriate replacement or a change in combination thereof.

Although not disclosed in the above-described embodiment, the members, configuration, and the like that are disclosed in the above-described embodiment and can be assumed and replaced by those skilled in the art based on the related art can be applied through an appropriate replacement or a change in combination thereof.

This application is a continuation application of U.S. patent application Ser. No. 14/213,883, filed Mar. 14, 2014, which patent application is incorporated herein by reference in its entirety. U.S. patent application Ser. No. 14/213,883 claims the benefit of and priority of Japanese Patent Application No: 2013-067435, filed Mar. 27, 2013 is expressly incorporated by reference herein in its entirety.

What is claimed is:

1. A liquid ejecting head comprising:

a head chip that includes a flow path forming plate and a nozzle plate;

a case member that includes a communication path which is a flow path; and a cover member, wherein a wall-shaped enclosure is disposed through integral molding with the case member to form a predetermined space, wherein the wall-shaped enclosure is provided on a printing medium side of the case member, wherein the cover member is fixed to a part of the wall-shaped enclosure and to the head chip to contain the head chip in the predetermined space and wherein the head chip communicates with the communication path in the predetermined space, wherein the cover member is fixed to the head chip such that the nozzle plate is recessed relative to the cover member, and wherein the cover member is fixed to a compliance member which is fixed to a cover member side surface of the flow path forming plate.

2. The liquid ejecting head according to claim 1, wherein the case member further includes a planar section where the communication path is disposed, and wherein a circuit substrate that drives an actuator which is provided in the head chip is attached to the planar section.

3. The liquid ejecting head according to claim 1, wherein the wall-shaped enclosure is continuously formed to continuously cover a vicinity of the predetermined space.

4. The liquid ejecting head according to claim 1, wherein the wall-shaped enclosure is formed to be thicker than another wall surface of the case member.

5. A liquid ejecting apparatus that performs printing by relatively moving a liquid ejecting head and a printing medium, comprising:

a head chip that includes a flow path forming plate and a nozzle plate;

a case member that includes a communication path which is a flow path and a cover member, wherein a wall-shaped enclosure that is disposed through integral molding with the case member to form a predetermined space, wherein the wall-shaped enclosure is provided on a printing medium side of the case member, wherein the cover member is fixed to a part of the wall-shaped enclosure and to the head chip to contain the head chip in the predetermined space and wherein the head chip communicates with the communication path, wherein the cover member is fixed to the head chip such that the nozzle plate is recessed relative to the cover member, and wherein the cover member is fixed to a compliance member which is fixed to a cover member side surface of the flow path forming plate.

* * * * *